US007290313B2

(12) United States Patent
Southern

(10) Patent No.: US 7,290,313 B2
(45) Date of Patent: Nov. 6, 2007

(54) CLASP

(75) Inventor: Andrew Richard Southern, Liverpool (GB)

(73) Assignee: Royal College of Art, London (GB)

( * ) Notice: Subject to any disclaimer, the term of this patent is extended or adjusted under 35 U.S.C. 154(b) by 0 days.

(21) Appl. No.: 10/518,809

(22) PCT Filed: Jun. 24, 2003

(86) PCT No.: PCT/GB03/02704

§ 371 (c)(1),
(2), (4) Date: Oct. 18, 2005

(87) PCT Pub. No.: WO04/000059

PCT Pub. Date: Dec. 31, 2003

(65) Prior Publication Data

US 2006/0090309 A1 May 4, 2006

(30) Foreign Application Priority Data

Jun. 25, 2002 (GB) ..... 0214658.7

(51) Int. Cl.
*A44B 11/25* (2006.01)

(52) U.S. Cl. ..... 24/614; 24/587.12; 24/DIG. 38; 24/DIG. 42

(58) Field of Classification Search ..... 24/614, 24/615, 584.1, 586.1, 586.11, 587.12, DIG. 38, 24/DIG. 41, DIG. 42
See application file for complete search history.

(56) References Cited

U.S. PATENT DOCUMENTS 2,648,884 A * 8/1953 Loofboro ..... 24/303
4,569,106 A * 2/1986 Lovato ..... 24/615

(Continued)

FOREIGN PATENT DOCUMENTS

EP 0 305 130 2/1983

(Continued)

*Primary Examiner*—Robert J. Sandy
(74) *Attorney, Agent, or Firm*—Hunton & Williams LLP

(57) ABSTRACT

A clasp is described that comprises two identical parts (10,12) that can be joined together to fasten the clasp and that can be separated from each other to release the clasp. Each of the first and second parts includes:
a) a resilient latch (14) with an outwardly facing barb (26);
b) a channel (32) for receiving the barb of the other part;
c) a catch (35) located in the channel for engagement with the barb of the other part when the two parts are pushed together in an axial direction (A);
d) a housing (16) containing the channel and extending transversely over the width of the part, the housing having an interface surface (20) extending between the latch (14) and the catch (35) and abutting the corresponding interface surface of the other part when the clasp is fastened, the interface surface extending diagonally with respect to the axial direction (A) such that the interface surface in the region of the catch (35) is located axially behind the interface surface in the region of the barb (26);

The barb (26) of each part engages the catch (35) of the other part as the two parts are pushed together, the engagement keeping the parts together. The latches (14) of the two parts can be moved to release each barb (26) from the catch (35) of the other part. The interface surfaces (20) of the two parts are arranged to slide over each other to separate the two parts when the barbs are released from the catches.

5 Claims, 2 Drawing Sheets

U.S. PATENT DOCUMENTS

| | | | | | |
|---|---|---|---|---|---|
| 4,621,393 | A | | 11/1986 | Ambal | |
| 4,779,315 | A | * | 10/1988 | Kohus | 24/587.12 |
| 5,170,539 | A | | 12/1992 | Lundstedt et al. | |
| 5,203,058 | A | | 4/1993 | Krauss | |
| 5,224,247 | A | * | 7/1993 | Collier | 24/587.12 |
| 5,261,257 | A | * | 11/1993 | Collier | 70/456 R |
| 5,392,616 | A | | 2/1995 | Ballenegger | |
| 5,735,024 | A | | 4/1998 | Ortiz | |
| 6,481,065 | B2 | * | 11/2002 | Cogdill | 24/303 |
| 6,826,806 | B2 | * | 12/2004 | Eaton et al. | 24/115 F |
| 2003/0121129 | A1 | * | 7/2003 | Hamilton | 24/615 |

FOREIGN PATENT DOCUMENTS

| | | |
|---|---|---|
| GB | 1143377 | 2/1969 |
| GB | 2116626 | 9/1983 |
| JP | 06154012 | 6/1994 |

* cited by examiner

CLASP

TECHNICAL FIELD

The present invention relates to a clasp for joining together two webs. Such devices are sometimes called "clips" and "buckles" and the words "clasp", "buckles" and "clips" are used synonymously in this specification.

BACKGROUND ART

Clasps for connecting together webs and straps are well known and widely used for such diverse applications as securing the two ends of a belt together, closing rucksacks and other bags and sacks, fastening coats and waterproofs and so on. The almost universally accepted design nowadays for such clasp consists of two parts secured to respective webs, one of the parts (the male part) consists of a pair of prongs, each having an outwardly extending barbed tooth and the other part (the female part) has a channel into which the prongs can be pushed. The width of the channel is smaller than the distance between the outsides of the prongs and so, as the male part is pushed into the channel, the prongs are flexed inwardly by the outer walls of the channel. The walls includes a pair of openings into which the barbed teeth can snap when the male part has been pushed sufficiently far into the channel. The engagement of the barbs in the channel wall openings retains the two parts together and so connects the webs attached to the two parts.

A guide prong is provided between the two barbed prongs in the male part of the clasp; the guide prong engages ridges in the channel of the female member to ensure that the male member travels axially along the channel.

In order to undo the clasp, the prongs are pinched to move towards each other thereby releasing the barbs from the openings and allowing the male part to be withdrawn from the female part.

Because the openings are exposed, it is possible for a user to catch his/her fingers between the barb and the opening, which can be painful.

U.S. Pat. Nos. 5,203,058, 5,735,024, EP-0305130 and GB 21116626 each describes a clasp or buckle for fastening straps having two identically-shaped parts; each part has a male prong and a female channel with the male prong of each part being arranged opposite to the female channel of the other part so that when the two parts are pushed together, the male prongs can engage in the respective female channels. The prongs have barbs that engage in openings in the channels to hold the buckle in a fastened condition. The barbs can be moved to disengage the barbs from the openings and so release the buckle. The two parts of the buckle, once the barbs are released, must be separated to open the buckle completely unless the tension in the straps is sufficient to pull the prongs out of the channels; however, if the tension is sufficient to pull the parts of the buckle apart, the same tension can make it difficult to release the prong barbs from the channel openings.

The present invention provides an alternative design of clasp where the two parts of a buckle separate from each other without the need for tension in the straps.

DISCLOSURE OF INVENTION

According to the present invention, there is provided a clasp that comprises a first part and a second part that can be joined together to fasten the clasp and that can be separated from each other to release the clasp, wherein the first and the second parts are identical to each other, and each of the first and second parts includes:

- a resilient latch with an outwardly facing barb;
- a channel for receiving the barb of the other part;
- a catch located in the channel for engagement with the barb of the other part when the two parts are pushed together in an axial direction; and
- a housing containing the channel and extending transversely over the width of the part, the housing having an interface surface extending between the latch and the catch and abutting the corresponding interface surface of the other part when the clasp is fastened, the interface surface extending diagonally with respect to the axial direction such that the interface surface in the region of the catch is located axially behind the interface surface in the region of the barb;

wherein the arrangement of the barb and the catch of each part is such that the barb of each part engages the catch of the other part as the two parts are pushed together to keep the parts together and the latches of the two parts can be moved to release each barb from the catch of the other part and wherein the interface surfaces are arranged to slide over each other to separate the two parts when the barbs are released from the catches.

As used in the present specification, the expression "axial direction" is intended to denote the direction in which a part is moved to fasten the clasp. The term "transverse direction" is intended to denote a direction generally perpendicular to the axial direction.

The sloping interface surfaces mean that the parts move apart from each other on release of the two parts of the clasp.

Because the two parts of the clasp are identical, only one mould is required to make the clasp and only one stock number is necessary. It also makes packaging easier as compared to the prior art since where there is a need to ensure that one male and one female part are provided together. In addition, it makes the handling of the parts easier as compared to the prior art where it is sometimes necessary to ensure that the male and female parts are attached to specific webs.

On each part, the barb and the catch are preferably not arranged side-by-side in the transverse direction but rather the catch is located axially behind the barb so that the shaft of the latch can be engaged by the user to press it inwardly to release the barb from the catch and so release the clasp. In this way, the shafts of the latches that are pressed to release the clasp are located opposite to each other, which makes the opening of the clasp easier.

The latch preferably forms a wall of the housing of each of the parts, the latch being moveable with respect to the rest of the housing to release the barb from the catch and open the clasp.

BRIEF DESCRIPTION OF DRAWINGS

There will now be described, by way of example only, an embodiment of the clasp according to the present invention by reference to the accompanying drawings in which.

BEST MODE OF CARRYING OUT THE INVENTION

Figure 3:
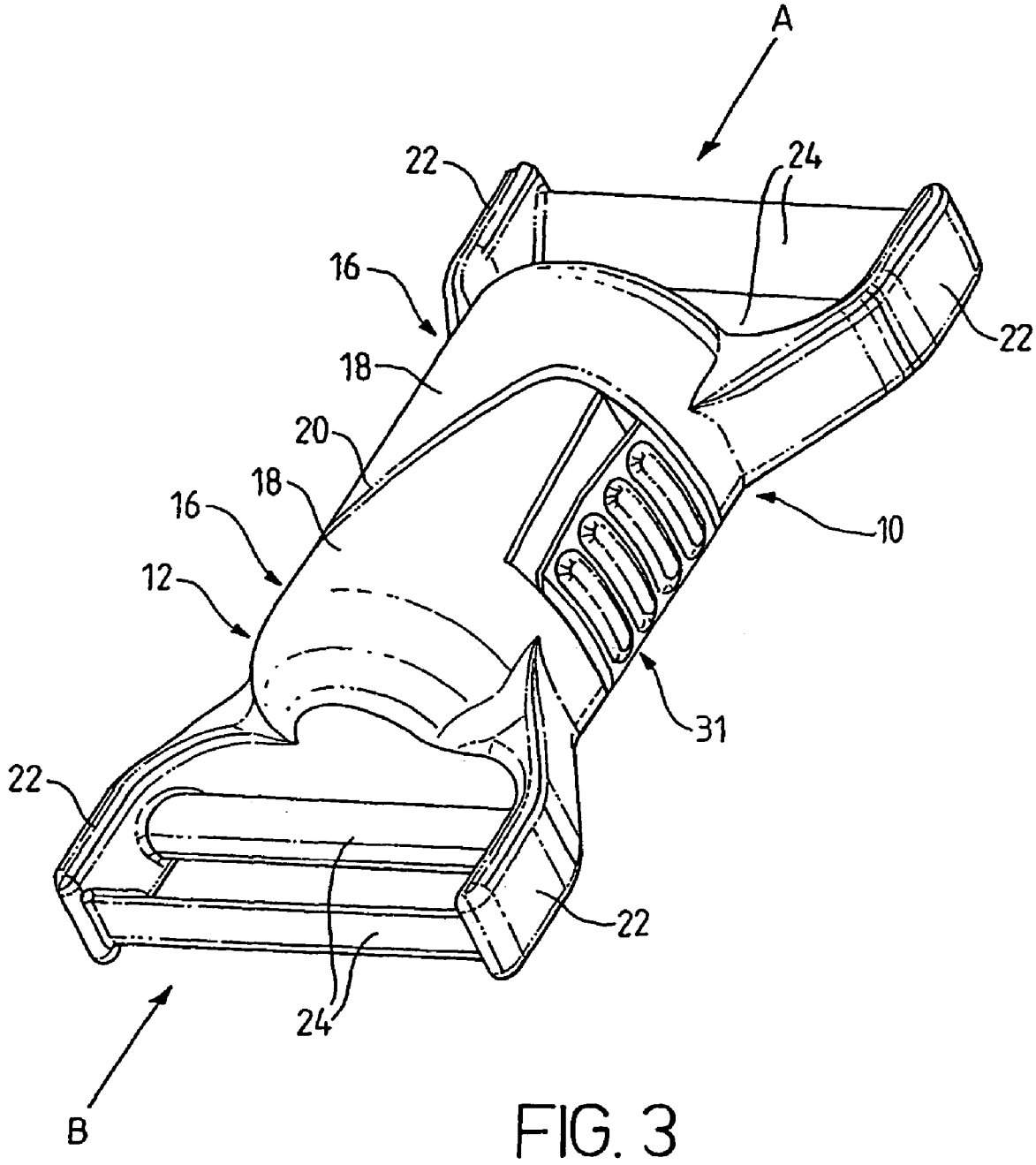
FIG. 3 shows the manner in which the clasp of FIGS. 1 and 2 is fastened.

Referring initially to FIG. 3, the clasp includes two identical parts 10 and 12 that are joined together to form a clasp. As will be described in more detail below, the clasp can be fastened by pushing the two parts 10,12 together in an axial direction indicated by arrows A and B for the two parts 10 and 12. The clasp can be opened by pressing on buttons 31 (only one visible in FIG. 3).

Figure 1:
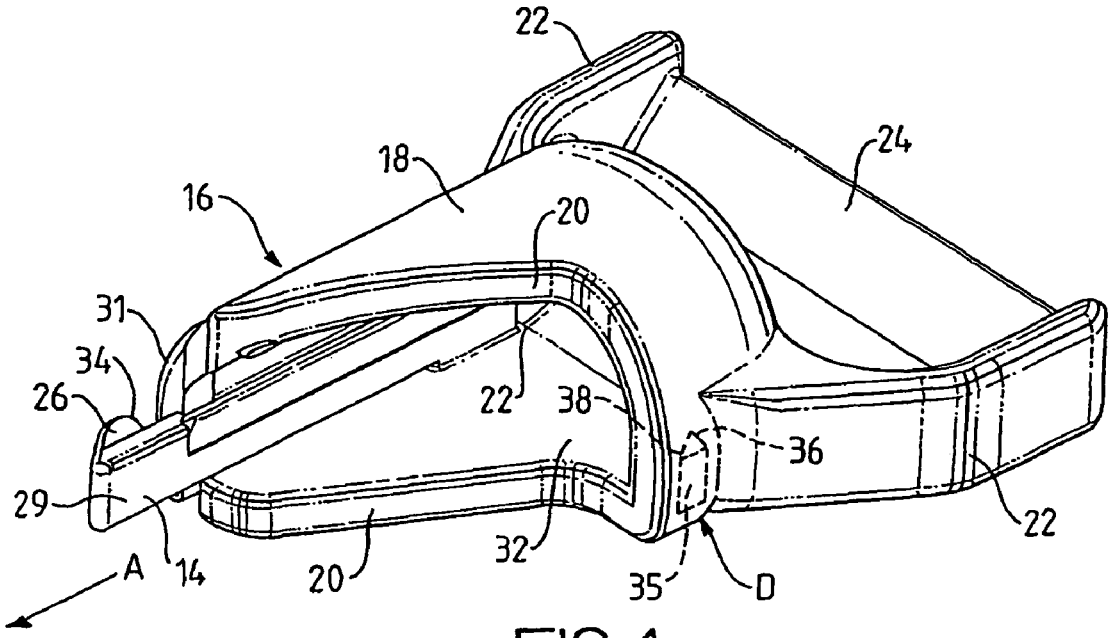
FIG. 1 is a perspective view of a clasp in accordance with the present invention.
Figure 2:
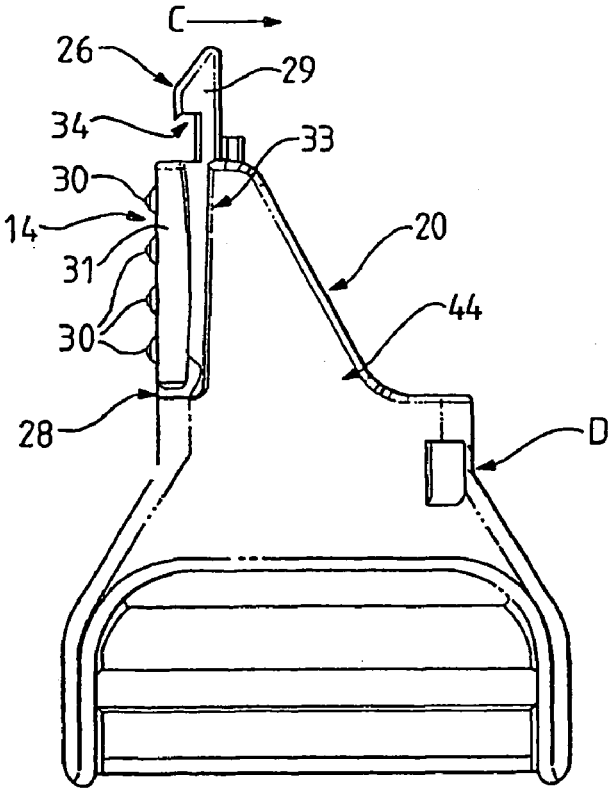
FIG. 2 is a base view of the clasp of FIG. 1.

The two parts 10,12 each have a housing 16 formed by a rounded upper surface 18 and a flat bottom surface (shown in FIGS. 1 and 2). The two parts 10,12 abut each other along a diagonal interface surface 20.

At the rear of the housing 16, each part has a pair of forked arms 22 and a pair of bars 24 extend between these arms to form a ladder fastening for securing the clasp to webs or straps that are to be joined. The webs are threaded around the bars in a known manner. Alternatively, the webs can be stitched onto the bars 24.

Referring now to FIGS. 1 and 2, these Figures show one of the parts 10 in more detail but it will be appreciated that since the two parts 10,12 are identical, the description applies equally to the second part 12.

The housing 16 and the interface surfaces 20 are clearly visible in FIG. 2. The buttons 31 form part of a latch 14, at one end of which there is a barb 26 on the outer side of the latch; at its other end 28, the latch is anchored to the housing thus forming a cantilever that can flex inwardly by pushing the button 31 of the latch 14 inwardly in the direction of arrow C. Ridges 30 are provided on the outside of the button 31 indicating the place at which the latch should be pushed to open the clasp. The button 31 is wider than the shank 29 of the latch (i.e. the part of the latch carrying the barb 26). The distance that the latch 14 can travel in the direction of arrow C is limited by the engagement of the button 31 with a stop surface 33.

The housing 16 is hollow and has an internal cavity 32. As shown, the latch 14 is located along one side of the housing and indeed forms a side wall of the housing. In the opposite side wall, there is a catch 35 (not visible but it is shown in broken lines in FIG. 1 and its position is indicated by arrow D). The catch 35 is moulded in the housing wall within the internal cavity 32 and has a cam surface 38 and an engagement surface 36 extending transverse to the axial direction A.

The barb 26 has an under-surface 34. When the clasp is to be fastened, the two parts 10,12 are pushed towards each other in the direction of arrows A and B (FIG. 3). The latch 14 of one part is therefore located adjacent to the catch 35 on the other part so that as the parts 10,12 are pushed together, a sloping surface 40 of the barb 26 engages the cam surface 38 of the catch, causing the latch to flex inwardly until the barb has passed the catch, whereupon the latch moves outwards because of the resilience of the latch causing the underside of the 34 of the barb 26 to engage behind the engagement surface 36 of the catch, preventing the parts 10,12 being pulled apart. It is of course evident that because each part 10,12 has both a latch 14 and a catch 35, the clasp is closed at each of its sides with the above arrangement.

In order to release the clasp, the latches 14 on the opposed sides of the clasp should be squeezed to move the latches in the direction of arrow C to a position in which the barbs 26 lie inwardly of the corresponding catches 35 and so the two parts 10,12 can be separated. Because the buttons 31 of the two parts 10,12 are located opposite each other, the act of pressing them does not cause the clasp to slew round when pressed. The clasp has depth to it, which makes it stable when pressing the release buttons 31.

Very little physical strength is needed to separate the parts 10,12 of the clasp, making it available to children, the elderly and the infirm.

The flat base 44 allows the clasp to lie flat against a surface if the webs are tensioned, e.g. if the webs are straps on a suitcase, the flat base 44 lies against the suitcase and does not press into the case. The flat surface also allows the manufacturer to mark the product, either with its own name or with advertising.

The D-shape cross section of the housing 16 dictates to users how the two parts 10,12 should be connected together since it is apparent that the flat base of the two parts 10,12 should align with each other.

The shape of the diagonal interface surface 20 is important. If the parts 10,12 are not properly aligned, the engagement of the surfaces 20 of the two parts 10,12 with each other pushes the parts 10,12 into their correct alignment for fastening. There is thus no need for a central guide prong to help align and locate the two parts 10,12 as is the case with the prior art. In addition, as the clasp has a diagonal interface surface, the pressing on buttons 31 will tend to cause the housing parts 18 to slide along the diagonal interface as soon as the barbs 26 are released causing the clasp to fly apart, which means that opening of the claps is simple.

Since the catch 35 is not accessible from the outside, users cannot pinch their fingers when releasing the clasp.

The clasp can be made with one 3-pan set of injection moulds: upper half, lower half and centre core. The catch 36 and much of the spacing around the button 31 are moulded from the bottom half of the mould. The clasp can be moulded in any suitable plastic, e.g. nylon, and in any colour.

The invention claimed is:

1. A clasp that comprises a first part and a second part that can be joined together to fasten the clasp and that can be separated from each other to release the clasp, wherein the first and the second parts are identical to each other, and each of the first and second parts includes:

a) a resilient latch with an outwardly facing barb;

b) a channel for receiving the barb of the other part;

c) a catch located in the channel for engagement with the barb of the other part when the two parts are pushed together in an axial direction;

d) a housing containing the channel and extending transversely over the width of the part, the housing having an interface surface extending between the latch and the catch and abutting the corresponding interface surface of the other part when the clasp is fastened, the interface surface extending diagonally with respect to the axial direction such that the interface surface in the region of the catch is located axially behind the interface surface in the region of the barb;

wherein the arrangement of the barb and the catch of each part is such that the barb of each part engages the catch of the other part as the two parts are pushed together to keep the parts together and the latches of the two parts can be moved to release each barb from the catch of the other part and wherein the interface surfaces are arranged to slide over each other to separate the two parts when the barbs are released from the catches.

2. A clasp as claimed in claim 1, wherein, on each part, the barb and the catch are arranged such that the catch is located axially behind the barb.

3. A clasp as claimed in claim 1, wherein the latch and the catch are located on opposite sides of each part.

4. A clasp as claimed in claim 1, wherein the latch forms a side wall of the housing of each of the parts, the latch side wall being moveable with respect to the rest of the housing to release the barb from the catch and open the clasp.

5. A clasp as claimed in claim 1, wherein the latches of the two parts can be moved by a force applied laterally to each of the latches to release each barb from the catch of the other part, whereby the lateral forces causes the diagonal interface surfaces to slide over each other to move the two parts of the clasp apart.

* * * * *